US005363608A

United States Patent [19]

Conlan

[11] Patent Number: 5,363,608

[45] Date of Patent: Nov. 15, 1994

[54] SEE-THROUGH BUS STOP SHELTER

[76] Inventor: Michael D. Conlan, 1774 Bethany Ave., San Jose, Calif. 95132-1513

[21] Appl. No.: 82,388

[22] Filed: Jun. 28, 1993

[51] Int. Cl.[5] ..... E04H 1/00

[52] U.S. Cl. ..... 52/79.1; 52/66

[58] Field of Search ..... 52/79.1, 66

[56] References Cited

U.S. PATENT DOCUMENTS 3,762,109 10/1973 Cohen ..... 52/79.1 X 4,075,797 2/1978 Shaw ..... 52/74 X

*Primary Examiner*—Carl D. Friedman

*Assistant Examiner*—Creighton Smith

[57] ABSTRACT

A new and improved see-through bus stop shelter includes a rigid, opaque framework that defines an interior space which includes a first interior room and a second interior room. The framework also defines a first threshold between the space exterior to the framework and the first interior room. The framework also defines a second threshold between the first interior room and the second interior room. Transparent wall elements are connected to the framework. The transparent wall elements provide walls for the first interior room and the second interior room. A roof element is placed on top of the framework for providing a roof for the first interior room and the second interior room. The first interior room includes a horizontal seat member and a newspaper dispensing machine, and the second interior room includes a telephone and a mailbox. The roof element includes a first roof edge and a roof body portion, and the framework includes a first framework edge and an upper framework body portion. A hinge assembly is connected between the first roof edge and the first framework edge, such that the roof body portion can be rotated around the hinge assembly, whereby the roof body portion is raised above the upper frame work body portion. A collapsible roof support assembly, connected between the roof body portion and the upper framework body portion, is used for selectively supporting the roof body portion in a position raised above the upper framework body portion.

8 Claims, 4 Drawing Sheets

FIG 3
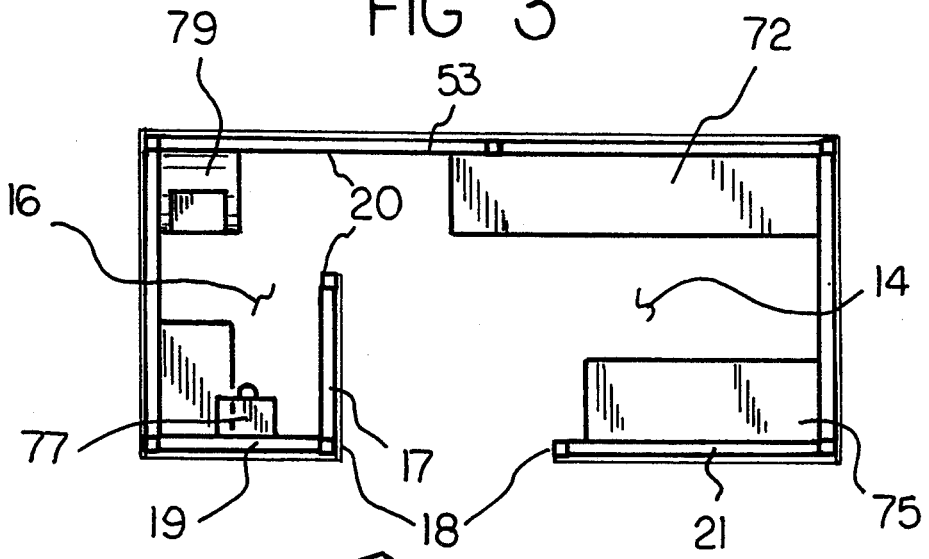
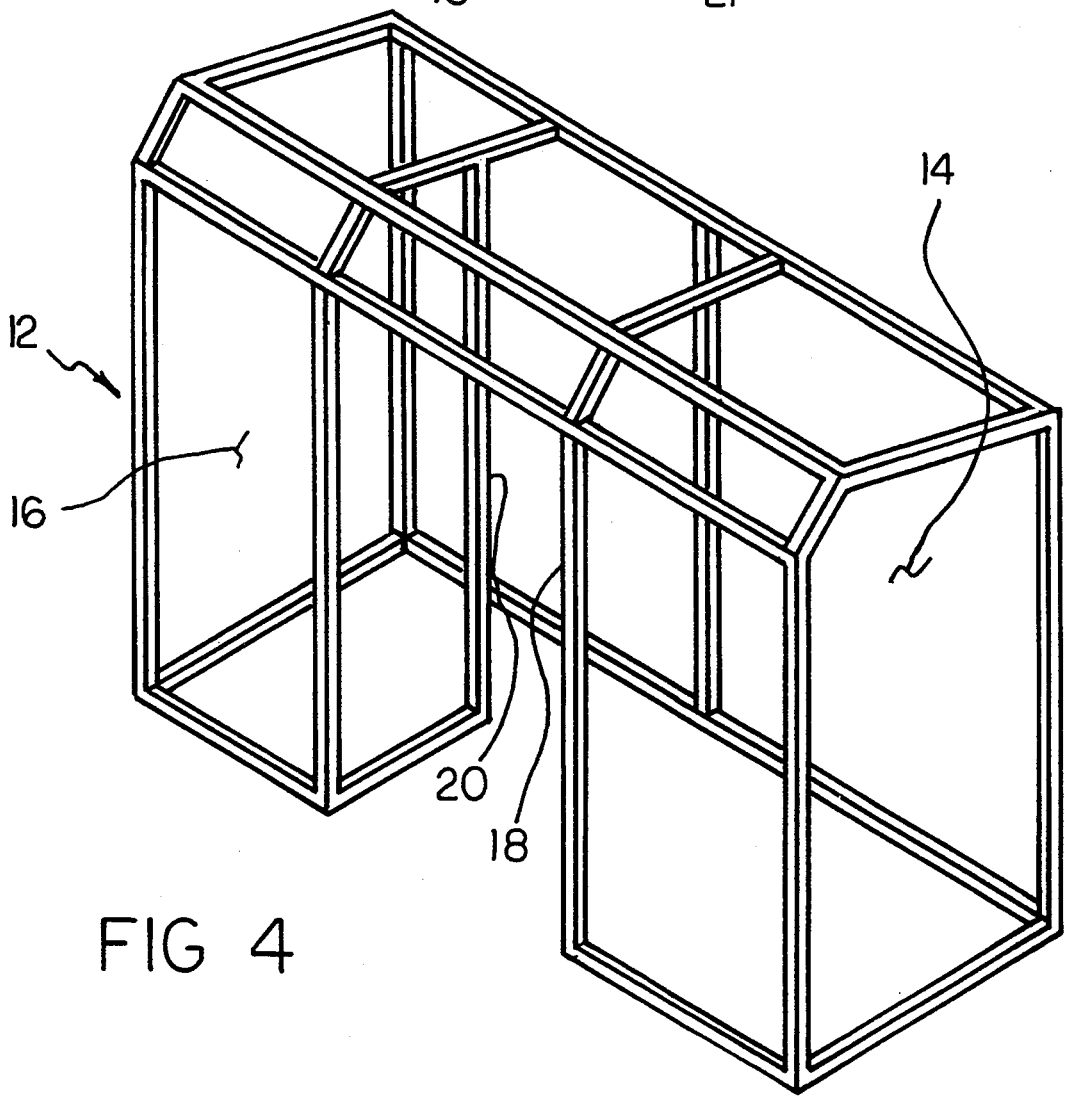
FIG 4

SEE-THROUGH BUS STOP SHELTER

BACKGROUND OF THE INVENTION

1. Field of the Invention

The present invention relates generally to small shelters, and more particularly to a small shelter especially adapted for use at a bus stop to protect people from the elements of rain, wind, and sun.

2. Description of the Prior Art

Small shelters are well known for use at bus stops to protect persons who are waiting for a bus from the elements of rain, wind, and sun. Some such shelters have only two exterior walls and a roof. One such shelter is shown in U.S. Pat. No. Des. 252,215. Other such shelters have only three exterior walls a roof. One such shelter is shown in U.S. Pat. No. 3,735,536. Some such shelters have tour exterior walls and a roof. One such shelter is shown in U.S. Pat. No. Des. 294,300. The following U.S. patents may be of interest for their disclosure of modular buildings that are not disclosed as being used for bus stop shelters: U.S. Pat. Nos. 3,455,075 and 4,173,102.

A problem associated with the bus stop shelters that have only exterior walls is that the interior of the bus stop shelter may be likened to one large room. As such, air can circulate freely and sound can travel unobstructed. Free circulation of air may be undesirable on cold and windy days. Unobstructed travel of sound may be undesirable when a private conversation is desired. In this respect, it would be desirable if a bus stop shelter were provided that prevented free circulation of air therein. In addition, it would be desirable if a bus stop shelter were provided that provided obstructions to the travel of sound therein.

Some bus stop shelters have opaque walls. Some bus stop shelters have generally opaque walls with transparent windows. Bus stop shelters that have opaque walls pose a danger. A criminal may not fear discovery if criminal activities can be carried out behind opaque walls. Opaque walls with transparent windows are somewhat of an improvement. However, greatest safety could be achieved if the walls of the bus stop shelter were completely transparent. In this respect, it would be desirable if a bus stop shelter were provided that had completely transparent walls.

As mentioned above, bus stop shelters generally may be likened to one big room. For purposes of greater protection against the elements of rain and wind and for greater privacy in terms of private voice conversations, it would be desirable if a bus stop shelter were provided that included one or more interior walls so as to divide the interior space of the bus stop shelter into more than one room-like area.

Often, in summer, a bus stop shelter can get quite hot inside due to the greenhouse effect. Hot air tends to rise, and the ceiling portion of the bus stop shelter may be especially uncomfortably hot. In this respect, it would be desirable if a bus stop shelter were provided that had a roof that can be raised so as to permit hot air to rise and escape from the shelter.

With a roof that can be raised, it would also be desirable that the roof, when raised to release hot air, could also continue to provide protection from the rain. In this respect, it would be desirable if a bus stop shelter were provided that had a raisable roof that continued to provide protection from the rain when the roof were raised.

With respect to a raisable roof, it would be desirable if a person using the bus stop shelter could easily exercise control over the raisable roof.

Bus stop shelters generally are designed to have one function: shelter people from the elements of wind, rain, and sun. However, when a person is waiting, often times the person would like to spend their time productively. One way want to make a telephone call. One may want to mail a letter. One may want to read a newspaper. In this respect, it would be desirable if a bus stop shelter were provided that included a telephone, a mail box, and a newspaper dispenser.

With a telephone in a bus stop shelter, for purposes of privacy, it would desirable if the telephone were placed in a separate, walled-off area in the bus stop shelter. In this respect, it would be desirable if a bus stop shelter were provided that included a separate, walled-off area serving as a telephone booth within the shelter.

Although the walls of a bus stop shelter are preferably made of transparent material, the framework for the shelter may be made from opaque material. The framework material may be made from strong metal components. Preferably, the metal framework components would be rust resistant or rust proof for long life. In this respect, it would be desirable if a bus stop shelter were provided that included a rust resistant metal framework that supported transparent walls.

Bus stop shelters often include seats inside the shelters. The seats may be independent of shelter structure itself. As such it may be especially susceptible to being removed from the shelter. In this respect, it would be desirable if a bus stop shelter were provided that included seats that were attached to the framework of the bus stop shelter.

Thus, while the foregoing body of prior art indicates it to be well known to use bus stop shelters, the prior art described above does not teach or suggest a see-through bus stop shelter which has the following combination of desirable features: (1) prevents free circulation of air therein; (2) provides obstructions to the travel of sound therein; (3) has completely transparent walls; (4) includes one or more interior walls so as to divide the interior space of the bus stop shelter into more than one room-like area; (5) has a roof that can be raised so as to permit hot air to rise and escape from the shelter; (6) has a raisable roof that continues to provide protection from the rain when the roof were raised; (7) has a raisable roof that can readily be raised of lowered by a person using the bus stop shelter; (8) includes a telephone, a mail box, and a newspaper dispenser; (9) includes a separate, walled-off area serving as a telephone booth within the shelter; (10) includes a rust resistant metal framework that supports transparent walls; and (11) includes seats that are attached to the framework of the bus stop shelter. The foregoing desired characteristics are provided by the unique see-through bus stop shelter of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved see-through bus stop shelter which includes a rigid, opaque framework that defines an interior space which includes a first interior room and a second interior room. The framework also defines a first threshold between the space exterior to the framework and the first interior room. The framework also defines a second threshold between the first interior room and the second interior room. Transparent wall elements are connected to the framework. The transparent wall elements provide walls for the first interior room and the second interior room. A roof element is placed on top of the framework for providing a roof for the first interior room and the second interior room. The first interior room includes a horizontal seat member and a newspaper dispensing machine, and the second interior room includes a telephone and a mailbox. The roof element includes a first roof edge and a roof body portion, and the framework includes a first framework edge and an upper framework body portion.

A hinge assembly is connected between the first roof edge and the first framework edge, such that the roof body portion can be rotated around the hinge assembly, whereby the roof body portion is raised above the upper framework body portion. A collapsible roof support assembly, connected between the roof body portion and the upper framework body portion, is used for selectively supporting the roof body portion in a position raised above the upper framework body portion.

The roof body portion includes an overhang portion that extends beyond an outermost frame member when the roof body portion is in a lowered position. The overhang portion shields the interior space from rain when the roof body portion is in an elevated position.

The collapsible roof support assembly includes a first link which includes a first pivot located at a first end of the first link and includes a second pivot located at a second end of the first link. A pivot-receiving aperture, located in the an upper framework body portion, receives the first pivot of the first link for pivotally connecting the first link to the upper framework body portion. A second link includes a first pivot located at a first end of the second link and includes a second pivot located at a second end of the second link. A pivot-receiving aperture, located in the roof body portion, receives the first pivot of the second link for pivotally connecting the second link to the roof body portion. A locking link is located between the first link and the second link. The locking link includes a first aperture for receiving the second pivot of the first link. The locking link includes a second aperture for receiving the second pivot of the second link. The locking link includes a closed side and an open side.

The locking link includes two modes of operation, such that, in a first mode of operation, when the roof body portion is elevated above the upper framework body portion, the locking link locks the roof body portion in an elevated position, and such that, in a second mode of operation, when the locking link is moved in a direction away from the open end, the first link and the second link are permitted to rotate about respective pivot-receiving aperture and pivot-receiving aperture whereby the collapsible roof support assembly collapses, and the roof body portion rests upon the an upper framework body portion.

A hand operated, remote control assembly is connected to the collapsible roof support assembly for remotely elevating, locking, unlocking, and lowering the roof body portion with respect to the an upper framework body portion. The collapsible roof support assembly includes a first link which includes a first pivot located at a first end of the first link and also includes a second pivot located at a second end of the first link. A pivot-receiving aperture, located in the an upper framework body portion, receives the first pivot of the first link for pivotally connecting the first link to the upper framework body portion. A second link includes a first pivot located at a first end of the second link and includes a second pivot located at a second end of the second link. A pivot-receiving aperture, located in the roof body portion, receives the first pivot of the second link for pivotally connecting the second link to the roof body portion.

A locking link is located between the first link and the second link. The locking link includes a first aperture for receiving the second pivot of the first link. The locking link includes a second aperture for receiving the second pivot of the second link. The locking link also includes a closed side and an open side. The hand operated, remote control assembly includes, a third pivot connected to the closed side of the locking link. A control rod is connected to the third pivot of the locking link.

A hand crank assembly includes a cranking link which includes a first cranking link aperture and a second cranking link aperture. A pivoted connection is present between the cranking link and the framework through the second cranking link aperture. Another pivoted connection is present between the cranking link and the control rod through the first cranking link aperture. A handle is connected to the control rod.

The locking link includes two modes of operation, such that, in a first mode of operation, the roof body portion is elevated above the an upper framework body portion by cranking the cranking link in a first direction. The locking link locks the roof body portion in an elevated position.

In a second mode of operation, the locking link is moved in a direction away from the open end by cranking the cranking link in a second direction. The first link and the second link are permitted to rotate about respective pivot-receiving aperture and pivot-receiving aperture whereby the collapsible roof support assembly collapses, and the roof body portion rests upon the an upper framework body portion. A seat assembly, which includes a horizontal seat member and a canted support member, is connected between an outer side of the horizontal seat member and the framework.

An illumination assembly provides illumination in the interior space when it is dark outside the apparatus.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved see-through bus stop shelter which has all of the advantages of the prior art and none of the disadvantages.

It is another object of the present invention to provide a new and improved see-through bus stop shelter which may be easily and efficiently manufactured and marketed.

It is a further object of the present invention to provide a new and improved see-through bus stop shelter which is of durable and reliable construction.

An even further object of the present invention is to provide a new and improved see-through bus stop shelter which is susceptible of a low cost of manufacture with regard to both materials and labor, and which accordingly is then susceptible of low prices of sale to the consuming public, thereby making such see-through bus stop shelter available to the buying public.

Still yet a further object of the present invention is to provide a new and improved see-through bus stop shelter which prevents free circulation of air therein.

Still another object of the present invention is to provide a new and improved see-through bus stop shelter that provides obstructions to the travel of sound therein.

Yet another object of the present invention is to provide a new and improved see-through bus stop shelter which has completely transparent walls.

Even another object of the present invention is to provide a new and improved see-through bus stop shelter that includes one or more interior walls so as to divide the interior space of the bus stop shelter into more than one room-like area.

Still a further object of the present invention is to provide a new and improved see-through bus stop shelter which has a roof that can be raised so as to permit hot air to rise and escape from the shelter.

Yet another object of the present invention is to provide a new and improved see-through bus stop shelter that has a raisable roof that continues to provide protection from the rain when the roof were raised.

Still another object of the present invention is to provide a new and improved see-through bus stop shelter which has a raisable roof that can readily be raised of lowered by a person using the bus stop shelter.

Yet another object of the present invention is to provide a new and improved see-through bus stop shelter which includes a telephone, a mail box, and a newspaper dispenser.

Still a further object of the present invention is to provide a new and improved see-through bus stop shelter that includes a separate, walled-off area serving as a telephone booth within the shelter.

Yet another object of the present invention is to provide a new and improved see-through bus stop shelter which includes a rest resistant metal framework that supports transparent walls.

Still a further object of the present invention is to provide a new and improved see-through bus stop shelter that includes seats that are attached to the framework of the bus stop shelter.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 3 is a cross-sectional view of the see-through bus stop shelter of FIG. 1 taken along line 3—3 thereof.

FIG. 4 is an exterior perspective view of the framework of the embodiment of the invention shown in FIG. 1.

DESCRIPTION OF THE PREFERRED EMBODIMENT

Figure 1:
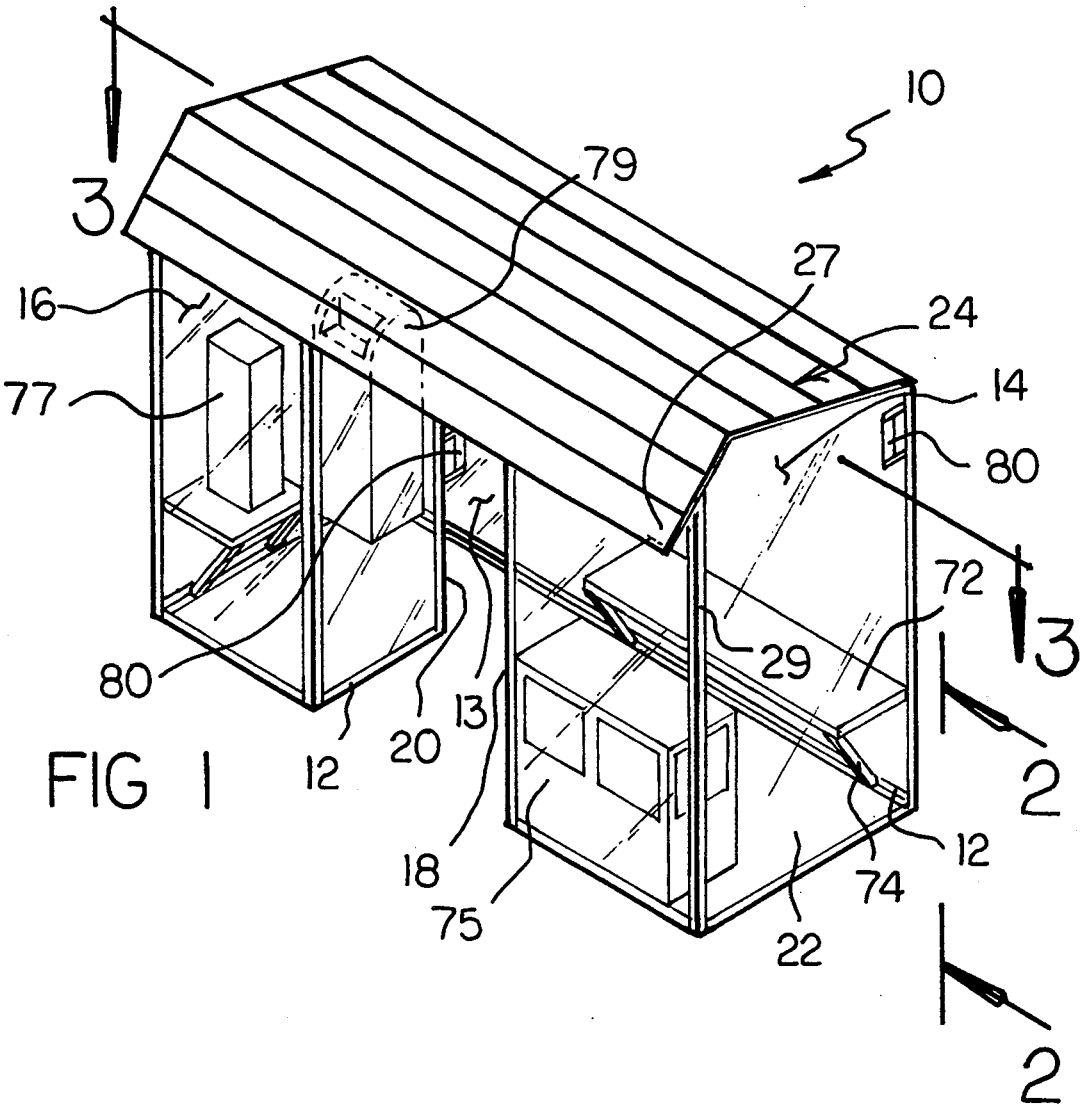
FIG. 1 is an exterior perspective view showing a first preferred embodiment of the see-through bus stop shelter of the invention.
Figure 2:
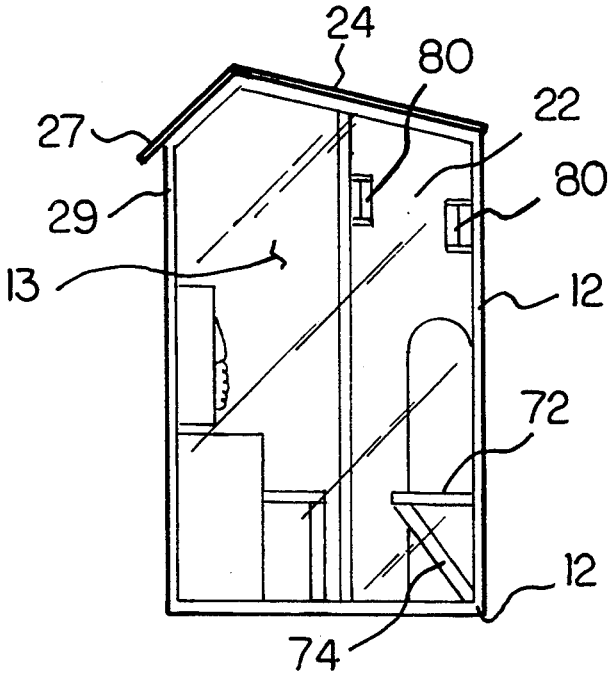
FIG. 2 is an exterior side view of tile see-through bus stop shelter along line 2—2 of FIG. 1 taken along the line 2—2 thereof.

With reference to the drawings, a new and improved see-through bus stop shelter embodying the principles and concepts of the present invention will be described.

Turning initially to FIGS. 1–4, there is shown a first exemplary embodiment of the see-through bus stop shelter of the invention generally designated by reference numeral 10. In its preferred form, see-through bus stop shelter 10 includes a rigid, opaque framework 12 that defines an interior space 13 which includes a first interior room 14 and a second interior room 16. The framework 12 also defines a first threshold 18 between the space exterior to the framework 12 and the first interior room 14. The framework 12 also defines a second threshold 20 between the first interior room 14 and the second interior room 16. Transparent wall elements 22 are connected to the framework 12. The transparent wall elements 22 provide walls for the first interior room 14 and the second interior room 16. A roof element 24 is placed on top of the framework 12 for providing a roof for the first interior room 14 and the second interior room 16. The interior wall 17 divides the interior space 13 into the first interior room 14 and the second interior room 16. The first threshold 18 is defined between exterior walls 19 and 21. The second threshold 20 is defined between the interior wall 17 and the exterior wall 53. The first interior room 14 includes a horizontal seat member 72 and a newspaper dispensing machine 75, and the second interior room 16 includes a telephone 77 and a mailbox 79. The roof element 24 includes a first roof edge 23 and a roof body portion 25, and the framework 12 includes a first framework edge 11 and an upper framework body portion 15.

Figure 5:
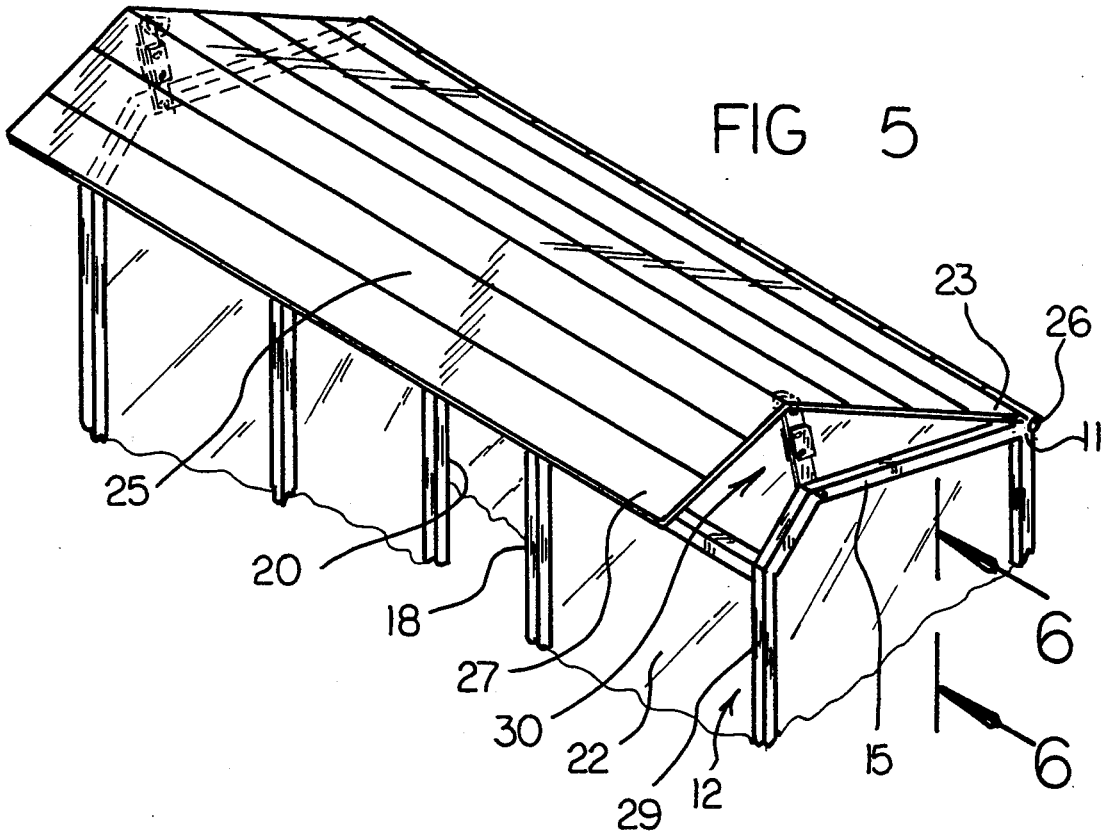
FIG. 5 is a partial exterior perspective view of a second preferred embodiment of the invention showing a raisable roof.
Figure 6:
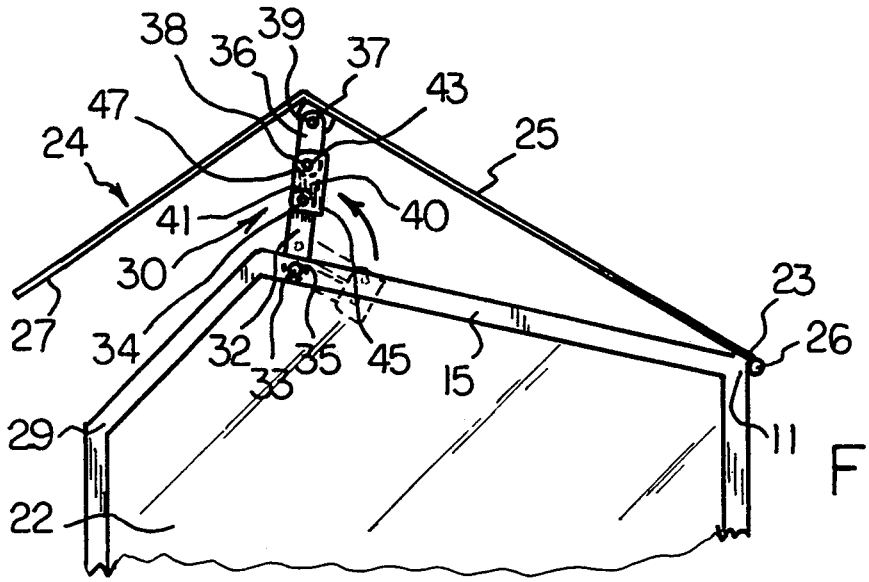
FIG. 6 is an exterior side view of the embodiment shown in FIG. 5 taken along the line 6—6 thereof.

Turning to FIGS. 5–6, a second embodiment of the invention is shown. Reference numerals are shown that correspond to like reference numerals that designate like elements shown in the other figures. In addition, a hinge assembly 26 is connected between the first roof edge 23 and the first framework edge 11, such that the roof body portion 25 can be rotated around the hinge assembly 26, whereby the roof body portion 25 is raised above the upper framework body portion 15. A collapsible roof support assembly 30, connected between the roof body portion 25 and the upper framework body portion 15, is used for selectively supporting the roof body portion 25 in a position raised above the upper framework body portion 15.

The roof body portion 25 includes an overhang portion 27 that extends beyond an outermost frame member 29 when the roof body portion 25 is in a lowered position. The overhang portion 27 shields the interior space 13 from rain when the roof body portion 25 is in an elevated position.

The collapsible roof support assembly 30 includes a first link 32 which includes a first pivot 33 located at a first end of the first link 32 and includes a second pivot 34 located at a second end of the first link 32. A pivot-receiving aperture 35, located in the an upper framework body portion 15, receives the first pivot 33 of the first link 32 for pivotally connecting the first link 32 to the upper framework body portion 15. A second link 36 includes a first pivot 37 located at a first end of the second link 36 and includes a second pivot 38 located at a second end of the second link 36. A pivot-receiving aperture 39, located in the roof body portion 25, receives the first pivot 37 of the second link 36 for pivotally connecting the second link 36 to the roof body portion 25. A locking link 40 is located between the first link 32 and the second link 36. The locking link 40 includes a first aperture 41 for receiving the second pivot 34 of the first link 32. The locking link 40 includes a second aperture 43 for receiving the second pivot 38 of the second link 36. The locking link 40 includes a closed side 45 and an open side 47.

The locking link 40 includes two modes of operation, such that, in a first mode of operation, when the roof body portion 25 is elevated above the upper framework body portion 15, the locking link 40 locks the roof body portion 25 in an elevated position, and such that, in a second mode of operation, when the locking link 40 is moved in a direction away from the open end 47, the first link 32 and the second link 36 are permitted to rotate about respective pivot-receiving aperture 35 and pivot-receiving aperture 39 whereby the collapsible roof support assembly 30 collapses, and the roof body portion 25 rests upon the an upper framework body portion 15.

Figure 7:
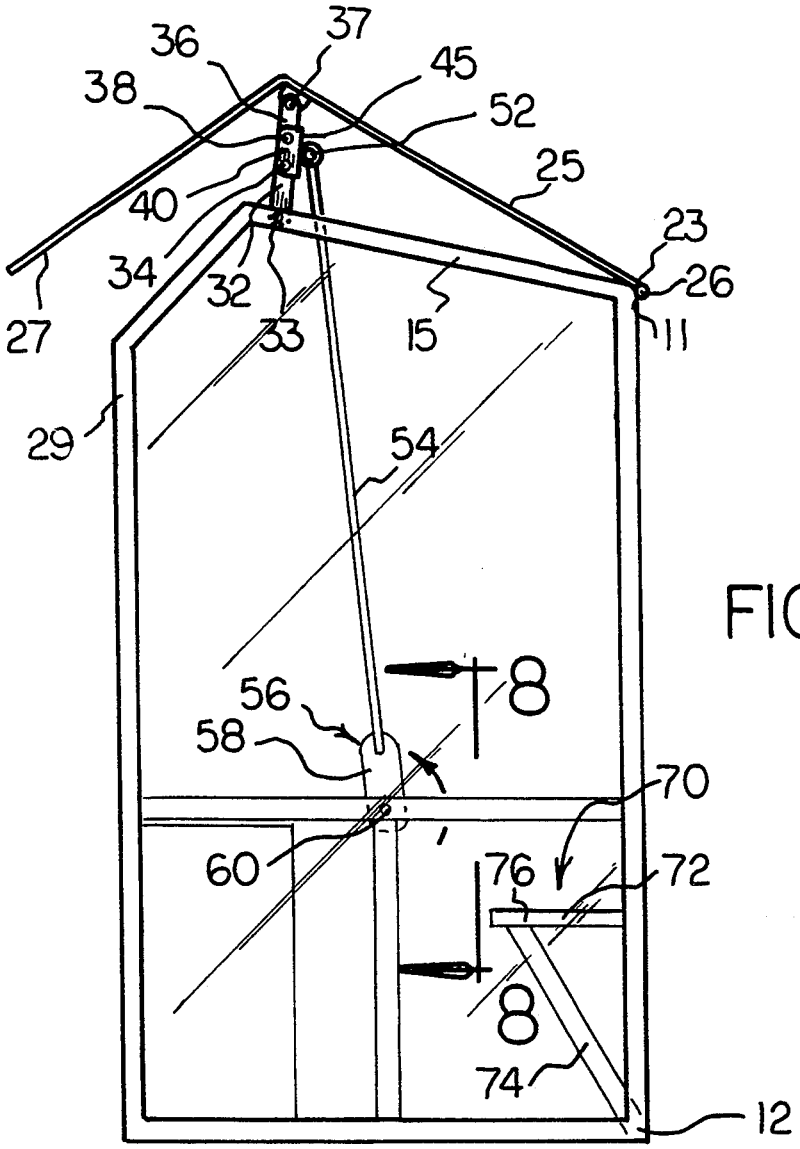
FIG. 7 is an exterior side view of a third embodiment of the see-through bus stop shelter of the invention showing a remotely controlled raisable roof.
Figure 8:
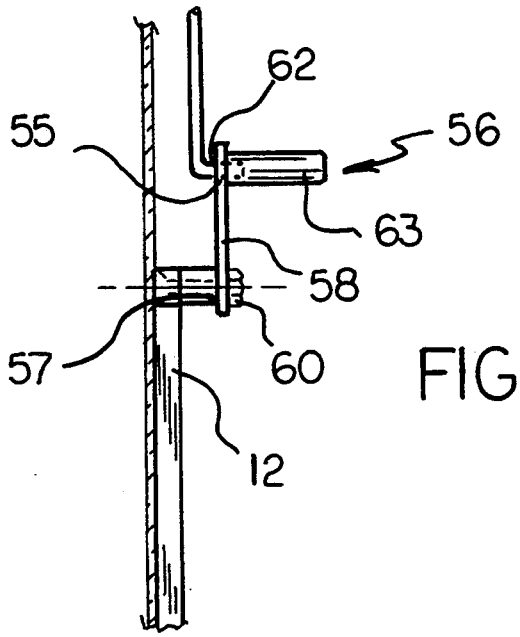
FIG. 8 is an interior side view of the embodiment of the invention shown in FIG. 7 taken along the line 8—8 thereof.

Turning to FIGS. 7–8, a third embodiment of the invention is shown. Reference numerals are shown that correspond to like reference numerals that designate like elements shown in the other figures. In addition, a hand operated, remote control assembly 50 is connected to the collapsible roof support assembly 30 for remotely elevating, locking, unlocking, and lowering the roof body portion 25 with respect to the an upper framework body portion 15. The collapsible roof support assembly 30 includes a first link 32 which includes a first pivot 33 located at a first end of the first link 32 and also includes a second pivot 34 located at a second end of the first link 32. A pivot-receiving aperture 35, located in the an upper framework body portion 15, receives the first pivot 33 of the first link 32 the pivotally connecting the first link 32 to the upper framework body portion 15. A second link 36 includes a first pivot 37 located at a first end of the second link 36 and includes a second pivot 38 located at a second end of the second link 36. A pivot-receiving aperture 39, located in the roof body portion 25, receives the first pivot 37 of the second link 36 for pivotally connecting the second link 36 to the roof body portion 25.

A locking link 40 is located between the first link 32 and the second link 36. The locking link 40 includes a first aperture 41 for receiving the second pivot 34 of the first link 32. The locking link 40 includes a second aperture 43 for receiving the second pivot 38 of the second link 36. The locking link 40 also includes a closed side 45 and an open side 47. The hand operated, remote control assembly 50 includes, a third pivot 52 connected to the closed side 45 of the locking link 40. A control rod 54 is connected to the third pivot 52 of the locking link 40.

A hand crank assembly 56 includes a cranking link 58 which includes a first cranking link aperture 55 and a second cranking link aperture 57. A pivoted connection 60 is present between the cranking link 58 and the framework 12 through the second cranking link aperture 57. Another pivoted connection 62 is present between the cranking link 58 and the control rod 54 through the first cranking link aperture 55. A handle 63 is connected to the control rod 54.

The locking link 40 includes two modes of operation, such that, in a first mode of operation, the roof body portion 25 is elevated above the an upper framework body portion 15 by cranking the cranking link 58 in a first direction, counterclockwise such that the control rod 54 pushes leftward in FIG. 7. The locking link 40 locks the roof body portion 25 in an elevated position.

In a second mode of operation, the locking link 40 is moved in a direction away from the open end 47 by cranking the cranking link 58 in a second direction, clockwise such that the control rod 54 pulls rightward in FIG. 7. The first link 32 and the second link 36 are permitted to rotate about respective pivot-receiving aperture 35 and pivot-receiving aperture 39 whereby the collapsible roof support assembly 30 collapses, and the roof body portion 25 rests upon the an upper framework body portion 15. The hand crank assembly 56 is located within the interior space 13 of the see-through bus stop shelter of the invention. By standing in the interior space 13, a person can remotely lift or lower the roof element 24 by operating the hand crank assembly 56. A seat assembly 70, which includes a horizontal seat member 72 and a canted support member 74, is connected between an outer side 76 of the horizontal seat member 72 and the framework 12.

An illumination assembly 80 provides illumination in the interior space 13 when it is dark outside the apparatus. The illumination assembly 80 can be source of illumination that is controlled by a photocell so that the source of illumination will go on automatically when it gets dark. A plurality of illumination assemblies 80 can be used to completely illuminate the interior space 13 of the see-through bus stop apparatus of the invention.

Briefly in review, the see-through bus stop shelter of the invention is an all weather, safe and convenient bus stop. It has a semi-private area with a pay phone, a mail box, and space for one or more newspaper racks as well as a bench in the phone area and a bench in tile waiting area. There can be full length fluorescent light fixtures controlled by a photocell so that the bus stop would be well lit during dusk and nighttime hours. The shelter has a metal frame, e.g. aluminum, with strong transparent plastic walls that are shatter proof and mar resistant. With its transparent walls (for example made of Plexiglass (TM)), the bus stop semi-isolates the pay phone area but still provides full visibility in that area and all throughout the bus stop. The roof can be made from embossed aluminum. The roof can be given the appearance of being shingles or tiled. The see-through bus stop shelter of tile invention is very convenient in its offering of mailing, phone, and newspaper services for a person waiting for a bus, trolley, taxicab, etc.. The local telephone company and newspaper company could pay a portion of the cost whereby cost to the bus company would be defrayed. In the event of an emergency, a placard advising the usual 911 number can be present. There may also be an 800 number posted to call to offer any information about vandalism or crimes. A notice of reward can also be provided with respect to information that leads to the conviction of a criminal.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved see-through bus stop shelter that is low in cost, relatively simple in design and operation, and which may advantageously be used to prevent free circulation of air therein. With the invention, a see-through bus stop shelter is provided which provides obstructions to the travel of sound therein. With the invention, a see-through bus stop shelter is provided which has completely transparent walls. With the invention, a see-through bus stop shelter is provided which includes one or more interior walls so as to divide the interior space of the bus stop shelter into more than one room-like area. With the invention, a see-through bus stop shelter is provided which has a roof that can be raised so as to permit hot air to rise and escape from the shelter. With the invention, a see-through bus stop shelter is provided which has a raisable roof that continues to provide protection from the rain when the roof were raised. With the invention, a see-through bus stop shelter is provided which has a raisable roof that can readily be raised of lowered by a person using the bus stop shelter. With the invention, a see-through bus stop shelter is provided which includes a telephone, a mail box, and a newspaper dispenser. With the invention, a see-through bus stop shelter is provided which includes a separate, walled-off area serving as a telephone booth within the shelter. With the invention, a see-through bus stop shelter is provided which includes a rust resistant metal framework that supports transparent walls. With the invention, a see-through bus stop shelter is provided which includes seats that are attached to the framework of the bus stop shelter.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved see-through bus stop shelter, comprising:

a rigid, opaque framework that defines an interior space which includes a first interior room and a second interior room, said framework also defining a first threshold between space exterior to said framework and said first interior room, said framework also defining a second threshold between said first interior room and said second interior room, transparent wall elements connected to said framework, said transparent wall elements providing walls for said first interior room and said second interior room, and a roof element placed on top of said framework for providing a roof for said first interior room and said second interior room, wherein said roof element includes a first roof edge and a roof body portion, and said framework includes a first framework edge and an upper framework body portion, further including:

a hinge assembly connected between said first roof edge and said first framework edge, such that said roof body portion can be rotated around said hinge assembly, whereby said roof body portion is raised above said upper framework body portion.

collapsible roof support assembly means, connected between said roof body portion and said upper framework body portion, for selectively supporting said roof body portion in a position raised above said Upper framework body portion.

2. The apparatus described in claim 1 wherein:

said first interior room includes a horizontal seat member and a newspaper dispensing machine, and said second interior room includes a telephone and a mailbox.

3. The apparatus described in claim 1 wherein said roof body portion includes an overhang portion that extends beyond an outermost frame member when said roof body portion is in a lowered position, and wherein said overhang portion shields said interior space from rain when said roof body portion is in an elevated position.

4. The apparatus described in claim 1 wherein said collapsible roof support assembly means include:

a first link including a first pivot located at a first end of said first link and including a second pivot located at a second end of said first link, a pivot-receiving aperture, located in said an upper framework body portion, receiving said first pivot of said first link for pivotally connecting said first link to said upper framework body portion, a second link including a first pivot located at a first end of said second link and including a second pivot located at a second end of said second link, a pivot-receiving aperture, located in said roof body portion, receiving said first pivot of said second link for pivotally connecting said second link to said roof body portion, and a locking link located between said first link and said second link, said locking link including a first aperture for receiving said second pivot of said first link, said locking link including a second aperture for receiving said second pivot of said second link, said locking link including a dosed side and an open side, said locking link including two modes of operation, such that, in a first mode of operation, when said roof body portion is elevated above said an upper framework body portion, said locking link locks said roof body portion in an elevated position, and such that, in a second mode of operation, when said locking link is moved in a direction away from said open end, said first link and said second link are permitted to rotate about respective pivot-receiving aperture and pivot-receiving aperture whereby said collapsible roof support assembly means collapse and said roof body portion rests upon said an upper framework body portion.

5. The apparatus described in claim 1, further including:

hand operated, remote control assembly means connected to said collapsible roof support assembly means for remotely elevating, locking, unlocking, and lowering said roof body portion with respect to said an upper framework body portion.

6. The apparatus described in claim 5 wherein said collapsible roof support assembly means include, a first link including a first pivot located at a first end of said first link and including a second pivot located at a second end of said first link, a pivot-receiving aperture, located in said an upper framework body portion, receiving said first pivot of said first link for pivotally connecting said first link to said upper framework body portion, a second link including a first pivot located at a first end of said second link and including a second pivot located at a second end of said second link, a pivot-receiving aperture, located in said roof body portion, receiving said first pivot of said second link for pivotally connecting said second link to said roof body portion, and a locking link located between said first link and said second link, said locking link including a first aperture for receiving said second pivot of said first link, said locking link including a second aperture for receiving said second pivot of said second link, said locking link including a closed side and an open side, wherein said hand operated, remote control assembly means include, a third pivot connected to said closed side of said locking link, a control rod connected to said third pivot of said locking link, and a hand crank assembly which includes a cranking link which includes a first cranking link aperture and a second cranking link aperture, a pivoted connection between said cranking link and said framework through said second cranking link aperture, a pivoted connection between said cranking link and said control rod through said first cranking link aperture, and a handle connected to said control rod, wherein said locking link includes two modes of operation, such that, in a first mode of operation, when said roof body portion is elevated above said an upper framework body portion by cranking said cranking link in a first direction, said locking link locks said roof body portion in an elevated position, and such that, in a second mode of operation, when said locking link is moved in a direction away from said open end by cranking said cranking link in a second direction, said first link and said second link are permitted to rotate about respective pivot-receiving aperture and pivot-receiving aperture whereby said collapsible roof support assembly means collapse and said roof body portion rests upon said an upper framework body portion.

7. The apparatus described in claim 1, further including:

a seat assembly which includes a horizontal seat member and a canted support member connected between an outer side of said horizontal seat member and said framework.

8. The apparatus described in claim 1, further including:

illumination assembly means for providing illumination in said interior space when it is dark outside said apparatus.

* * * * *